US008379907B2

(12) United States Patent
Yan

(10) Patent No.: US 8,379,907 B2
(45) Date of Patent: Feb. 19, 2013

(54) VIBRATING MEMBER AND ELECTROACOUSTIC TRANSDUCER HAVING SAME

(75) Inventor: Xu-Dong Yan, Shenzhen (CN)

(73) Assignees: AAC Acoustic Technologies (Shenzhen) Co., Ltd., Shenzhen (CN); American Audio Components Inc., La Verne, CA (US)

( * ) Notice: Subject to any disclaimer, the term of this patent is extended or adjusted under 35 U.S.C. 154(b) by 140 days.

(21) Appl. No.: 13/015,962

(22) Filed: Jan. 28, 2011

(65) Prior Publication Data

US 2011/0293121 A1 Dec. 1, 2011

(30) Foreign Application Priority Data

May 25, 2010 (CN) ..... 2010 1 0182972

(51) Int. Cl.
*H04R 25/00* (2006.01)

(52) U.S. Cl. ..... 381/429; 381/396; 381/423

(58) Field of Classification Search ..... 381/396, 381/398, 404, 423–424, 429, 431
See application file for complete search history.

(56) References Cited

U.S. PATENT DOCUMENTS 7,548,632 B2 * 6/2009 Fukuyama et al. ..... 381/429

* cited by examiner

*Primary Examiner* — Suhan Ni
(74) *Attorney, Agent, or Firm* — IPro, Inc.; Na Xu

(57) ABSTRACT

An electroacoustic transducer includes a frame defining a hollow space, and an elastic member mounted on the frame. The elastic member includes a circular plane lamina and a plurality of elastic arms extending outwardly from a circumference of the circular plane lamina. A diaphragm includes a vibrating film mounted with the circular plane lamina, and an edge damper integrally formed with an outer periphery of the vibrating film. A voice coil is attached below the vibrating film and electrically connected to the circular plane lamina. At least two through holes are formed between an outer periphery of the circular plane lamina and an inner side of the voice coil for balancing the air pressure of the air below the diaphragm.

8 Claims, 2 Drawing Sheets

VIBRATING MEMBER AND ELECTROACOUSTIC TRANSDUCER HAVING SAME

FIELD OF THE INVENTION

The present invention relates to transducers to be mounted in terminal equipments for converting electrical signals to audible sounds, and more particularly to an electroacoustic transducer.

DESCRIPTION OF RELATED ART

Sound which can be heard by a person's auditory sense is transmitted in the form of waves. The sound having the wave form moves air molecules and vibrates the tympanic membrane, thus allowing a person to hear the sound. In order to provide audible sounds, various kinds of speakers have been developed. The speaker is generally coupled to audio equipment or an amplifier for use as a large sound producing means for considerably amplifying volume. Alternatively, the speaker may be used as a small sound producing means having a small size and volume.

A speaker, which is mounted to an electronic product that is miniaturized and light, is a micro speaker. The micro speaker includes a case defining a cavity, a magnet positioned in the case, a pole plate disposed on the magnet, a diaphragm supported by the case, a voice coil attached to the diaphragm, and a cover pressing on a peripheral portion of the diaphragm. When alternating currents go through the voice coil, the magnet will drive the voice coil to vibrate and the diaphragm will also vibrate with the voice coil accordingly, which converts the currents into sound waves.

However, the performance of such micro speaker is not so good because it is not easy to balance the air pressure in the cavity during the vibration of the diaphragm. Therefore, it is desirable to provide a micro speaker which can overcome the above-mentioned problems.

Figure 1:
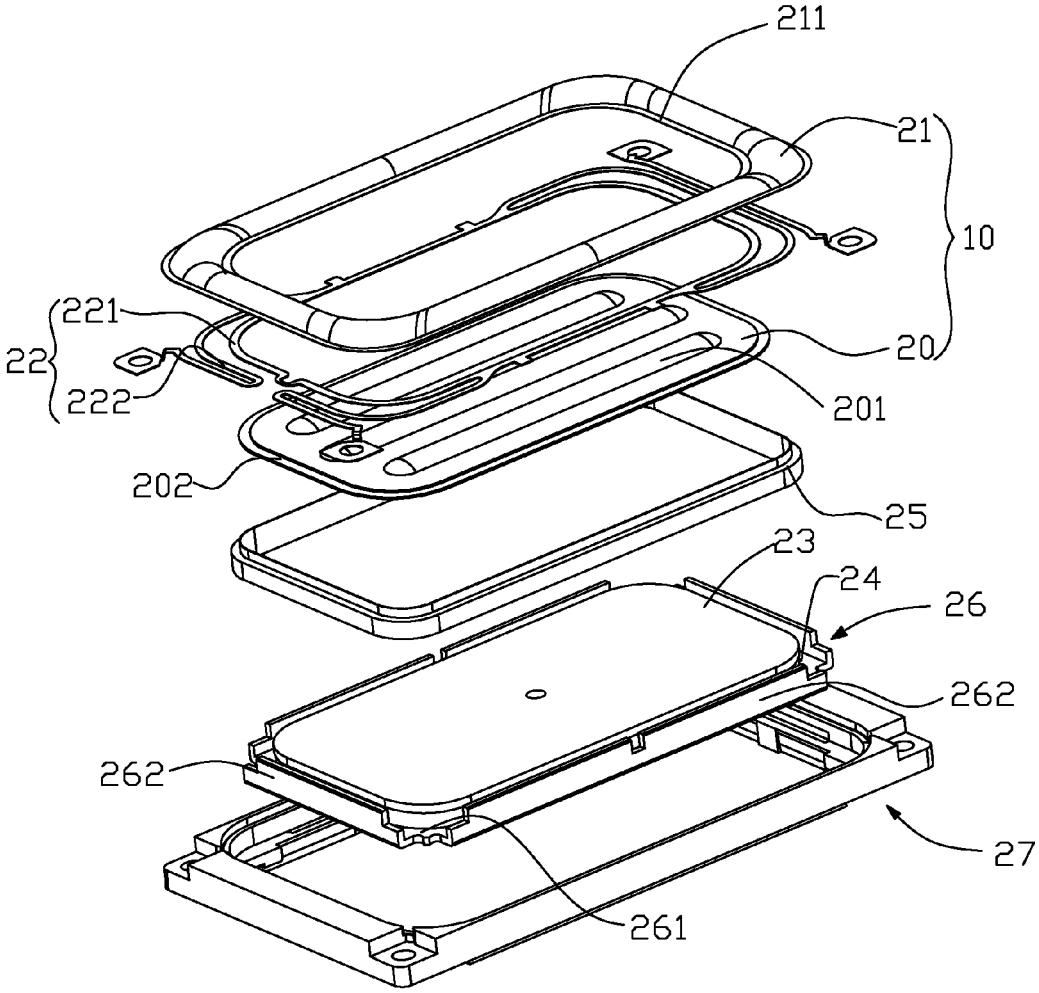
FIG. 1 is an exploded view of an electroacoustic transducer according to one exemplary embodiment of the present invention.

Many aspects of the embodiment can be better understood with reference to the drawings mentioned above. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

Reference will now be made to describe an exemplary embodiment of the present invention in detail.

Referring to FIG. 1, an electroacoustic vibrating transducer comprises a frame 27 forming a hollow space, a magnetic circuit part having a yoke 26 defining a bottom 261 and a sidewall 262 surrounding and approximately perpendicular to the bottom 261, and a receiving cavity is formed by the bottom 261 and the sidewall 262. A magnet 24 is received in the receiving cavity of the yoke 26, and a pole plate 23 attaches to a top surface of the magnet 24. A vibrating member includes a diaphragm 10 and a voice coil 25 suspended in the hollow space, and the magnetic circuit provides a magnetic gap for partially receiving the voice coil 25.

The electroacoustic transducer further comprises an elastic member 22 mounted on the frame 27. In this exemplary embodiment, the elastic member 22 belongs to the vibrating member. The elastic member 22 comprises a circular plane lamina 221 and a plurality of elastic arms 222 extending outwardly from a circumference of the circular plane lamina 221. The frame 27 accommodates the elements mentioned above therein.

Figure 2:
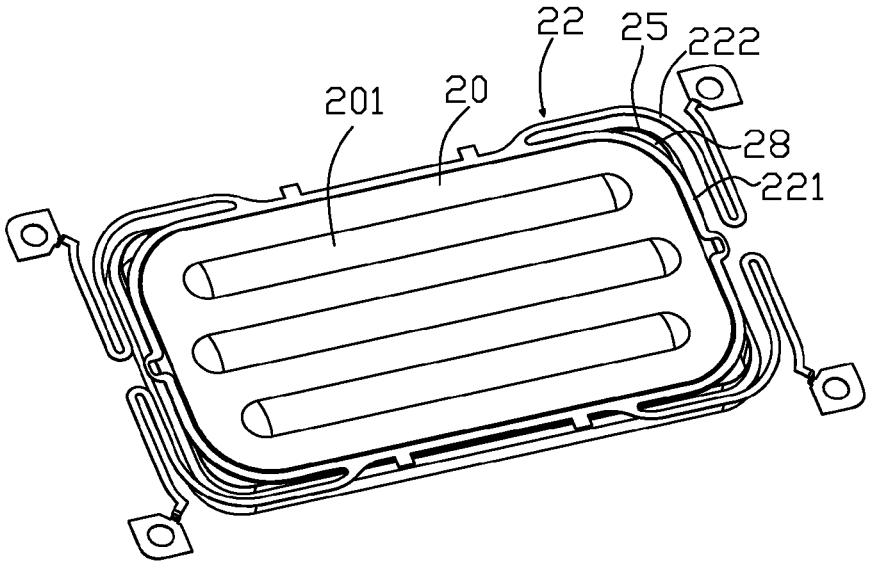
FIG. 2 is an assembled view of the electroacoustic transducer in FIG. 1, with a frame and a magnetic circuit thereof being removed.
Figure 3:
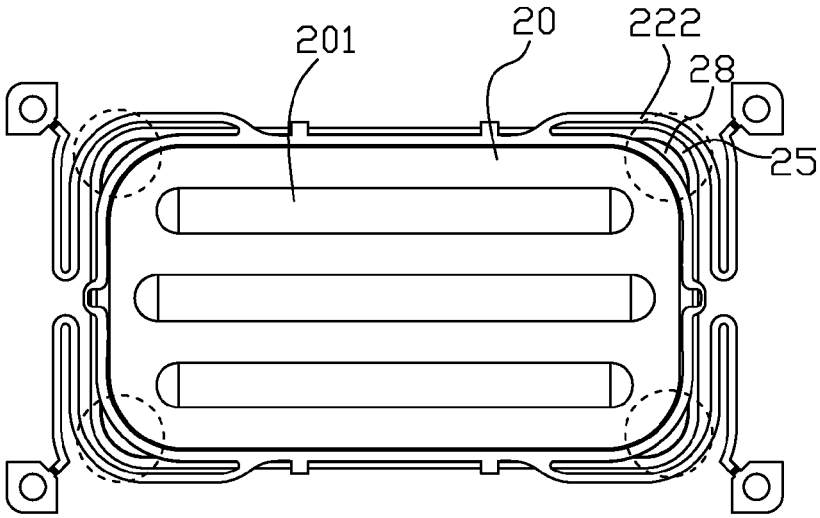
FIG. 3 is top view of an assembly of the diaphragm and an elastic member in FIG. 2.

Referring to FIGS. 2-3, the diaphragm 10 defines a vibrating film 20, and an edge damper 21 integrally formed with an outer periphery of the vibrating film 20. A plurality of reinforcing ribs 201, each of which is formed by a recess and projection structure, are formed on the surface of vibrating film 20. The vibrating film 20 is configured to be parts of a rectangle corresponding to the voice coil 25. The vibrating film 20 attaches to the circular plane lamina 221 and is electrically connected to leads of the voice coils 25. The vibrating film 20 further defines a peripheral part 202. The voice coil 25 can receive electrical signals via the elastic member 10. While assembled, the elastic member 22 is positioned above the vibrating film 20 with the circular plane lamina 221 attaching with the peripheral portion 202 of the vibrating film 20, and the edge damper 21 is positioned above the elastic member 22 with an inner periphery 211 attaching to the circular plane lamina 221. The voice coil 25 is attached to a lower surface of the vibrating film 20 and receives external signals via the elastic member 22. When electrified, the voice coil 25 vibrates in the magnetic gap and further drive the vibrating film 21 to vibrate for producing audible sounds. While the vibrating film 20 is vibrating, the air below the diaphragm in the hollow space is compressed and released alternately. In order to assure the performance of the speaker, leaking members are needed to balance the air pressure of the air in the hollow space.

In this exemplary embodiment, four through holes 28 are formed between an outer periphery of the circular plane lamina 221 and an inner side of the voice coil 25, and are separately located adjacent to a corner of the voice coil 25. The through holes 28 are completely symmetrical about a major-axis and a minor-axis of the voice coil 25. When the diaphragm 10 vibrates, the air below the diaphragm 10 will be compressed and then leaks outside via the through hole 28, which balances the air pressures between the air below the diaphragm 10 and the air out of the diaphragm 10. The amount of the through holes 28 is not limited to four, and can be increased or reduces according to actual requirements. Generally, at least two through holes are required to balance the air pressure.

In other exemplary embodiment of the present invention, the vibrating member in this embodiment comprises a diaphragm defining a vibrating film, an edge damper integrally formed with an outer periphery of the vibrating film, a voice coil located below the vibrating film, at least two through holes formed between an outer periphery of the vibrating film and an inner side of the voice coil. When the diaphragm vibrates, the air below the diaphragm will be compressed and then leaks outside via the through hole, which balances the air pressures between the air below the diaphragm and the air out of the diaphragm.

While the present invention has been described with reference to the specific embodiment, the description of the invention is illustrative and is not to be construed as limiting the invention. Various of modifications to the present invention can be made to the exemplary embodiment by those skilled in the art without departing from the true spirit and scope of the invention as defined by the appended claims.

What is claimed is:

1. A vibrating member, comprising:

a diaphragm defining a vibrating film, an edge damper integrally formed with an outer periphery of the vibrating film;

a voice coil located below the vibrating film;

at least two through holes formed between and cooperatively by an outer periphery of the vibrating film and an inner side of the voice coil for balancing the air pressure of the air below the diaphragm.

2. The vibrating member as described in claim 1, wherein the through holes are completely symmetrical about a major-axis and a minor-axis of the voice coil.

3. The vibrating member as described in claim 1, wherein the vibrating film is configured to be parts of a rectangle corresponding to the voice coil.

4. The vibrating member as described in claim 3, wherein four through holes are provided and are separately adjacent to a corner of the voice coil.

5. The vibrating member as described in claim 1, wherein a plurality of reinforcing ribs, each being formed by a recess and projection structure, are formed on the surface of vibrating film.

6. A vibrating member, comprising:

a diaphragm defining a vibrating film, an edge damper integrally formed with an outer periphery of the vibrating film;

an elastic member defining a circular plane lamina and a plurality of elastic arms extending outwardly from a circumference of the circular plane lamina, and the vibrating film mounted with the circular plane lamina;

a voice coil electrically connected to the circular plane lamina;

at least two through holes formed between and cooperatively by an outer periphery of the circular plane lamina and an inner side of the voice coil for balancing the air pressure of the air below the diaphragm.

7. The vibrating member as described in claim 5, wherein the four through holes are completely symmetrical about a major-axis and a minor-axis of the voice coil.

8. An electroacoustic transducer, comprising:

a frame defining a hollow space;

an elastic member mounted on the frame, the elastic member defining a circular plane lamina and a plurality of elastic arms extending outwardly from a circumference of the circular plane lamina;

a diaphragm defining a vibrating film, an edge damper integrally formed with an outer periphery of the vibrating film, and the vibrating film mounted with the circular plane lamina;

a voice coil attached below the vibrating film and electrically connected to the circular plane lamina; wherein at least two through holes are formed between and cooperatively by an outer periphery of the circular plane lamina and an inner side of the voice coil for balancing the air pressure of the air below the diaphragm.

* * * * *